United States Patent [19]

King

[11] 4,295,243

[45] Oct. 20, 1981

[54] FLOOR TREATING APPARATUS

[76] Inventor: Virginia B. King, P.O. Box 5274, 7528 Popen Dr., Knoxville, Tenn. 37918

[21] Appl. No.: 84,888

[22] Filed: Oct. 15, 1979

[51] Int. Cl.[3] ..... A47L 7/00; A47L 11/205

[52] U.S. Cl. ..... 15/320; 15/380

[58] Field of Search ..... 15/320, 321, 380

[56] References Cited

U.S. PATENT DOCUMENTS

| | | | |
|---|---|---|---|
| 1,472,208 | 10/1923 | Dawer | 15/320 |
| 1,769,796 | 7/1930 | Lepage | 15/380 X |
| 2,531,370 | 11/1950 | Thompson | 15/321 |
| 2,558,590 | 6/1951 | Smith | 15/320 |
| 3,101,505 | 8/1963 | Belicka et al. | 15/320 |
| 3,942,215 | 3/1976 | Olds | 15/320 |
| 4,154,578 | 5/1979 | Bane | 15/320 X |

*Primary Examiner*—Chris K. Moore

*Attorney, Agent, or Firm*—Pitts & Kesterson

[57] ABSTRACT

Apparatus for cleaning, waxing, polishing and otherwise treating the surface of a floor, including such floors as wood, tile, vinyl, concrete and the like is provided. The apparatus includes a carriage or frame with a handle for guiding and maneuvering. Attached to the carriage are several containers for dispensing several selected types of fluids or solutions to the floor where a reciprocating scrubber, such as steel wool or a buffing pad operates with the solutions to effectively clean, strip, wax or polish the floor surface. In addition, there is a vacuum means which removes and carries away any excess liquid, solution or dirty cleaning fluids from the floor surface. According to one embodiment of the apparatus, the location at which the vacuum is applied to the floor surface may be selectively changed from the rear of the machine to the front of the machine such that when the front of the machine is moved up against a wall or other obstruction, the vacuum can be applied to the front of the machine to more effectively remove any such liquids.

6 Claims, 8 Drawing Figures

FLOOR TREATING APPARATUS

BACKGROUND OF THE INVENTION

The apparatus of this invention relates broadly to a machine for cleaning and treating floors having hard surfaces such as wood, vinyl, tile, etc., and most specifically to a combination machine which can be used for several of the requirements for treating a floor including cleaning, stripping, waxing, polishing, etc. In addition, the machine of this invention also uses reciprocating motion applied to a rectangular scrubbing or polishing unit rather than a round rotating scrubbing unit.

The typical and presently available heavy duty floor cleaning and treating unit, uses one or more power driven, round, rotating scrub brushes or polishing pads. As is well known by persons familar with these machines they are difficult to guide and maneuver as they tend to "run away" if not carefully controlled. In addition, the large round brushes cannot, because of their shape be used to effectively clean the inside corners of the floor. Similarly, these machines with such round brushes cannot effectively strip, clean or polish a waxed floor. Consequently, floors which are continuously cleaned and waxed by such machines will eventually develop a large accumulation of dirt and wax build up at their inside corners. The accumulation of dirt and wax must then be removed by hand scrubbing at regular intervals if it is to be removed at all. Such hand scrubbing is, of course, time consuming and not nearly effective as power driven cleaning and waxing. In addition, the centrifigal force created by the rotating scrubber tends to sling any cleaning solution, wax or other fluid out and away from the brush or polishing pad in every direction. This slinging tendancy often results in dirty cleaning solutions being thrown against walls and over portions of the floor already cleaned, or wax being thrown over portions of the floor already buffed. In additon, the wide dispersal of fluid away from the machine makes it very difficult to vacuum or otherwise remove any excess fluid.

Thus, it is an object of this invention to provide apparatus which can be used for cleaning, waxing and polishing hard surface floors.

It is still another object of this invention to provide floor apparatus for cleaning and waxing which can reach to the inside corners of a floor.

It is yet another object of this invention to provide cleaning, waxing and polishing apparatus which does not tend to sling fluids or waxes over areas of a floor already treated.

It is another object of this invention to provide a combination machine which can be selectively used for cleaning, waxing and polishing.

It is also an object of this invention to provide a machine which can remove dirty cleaning solutions and excess waxes from a treated floor.

SUMMARY OF THE INVENTION

These objects and other objects which will become clear hereinafter are accomplished by the apparatus of this invention for cleaning and treating floors. This apparatus comprises a carriage or support means which has a handle for guiding and maneuvering the apparatus over the floor. A plurality of dispensing chambers are attached to the carriage means and hold a selection of floor cleaning or treating fluids which may selectively be applied to the floor. A reciprocating scrubbing means which is moveably attached to the carriage or support means works with the applied fluids for cleaning or otherwise treating the floor surface. A first transporting means connected between the dispensing chambers and the front of the scrubbing unit provides a path for transporting the selected fluid from the dispensing chamber to the scrubbing means. In addition, a receiving chamber is also attached to the carriage means and this receiving chamber is suitable for receiving any dirty cleaning solution or fluids as well as any excess liquid such as waxes and polishes. A second transporting means connected between the rear portion of the scrubbing means and the receiving chamber is used for transporting the dirty cleaning fluids, or the excess solutions from the floor to the receiving chamber. Transporting of the dirty fluid or excess fluid is accomplished by a vacuum means which draws a vacuum on the receiving chamber and the second transporting means such that any dirty solution or excess fluid is transferred from the scrubbing means to the receiving chamber. A power source such as an electric motor is used for driving the vacuum means and for imparting the reciprocating motion to the scrubbing means.

According to one specific embodiment, a selector valve is included which allows the operator of the machine to selectively control fluids to be dispensed to the scrubber means. In addition, the machine may also include apparatus for applying a vacuum in the front of the machine for use when the front of the machine being used is in contact with a wall.

DETAILED DESCRIPTION OF THE INVENTION

Figure 1:
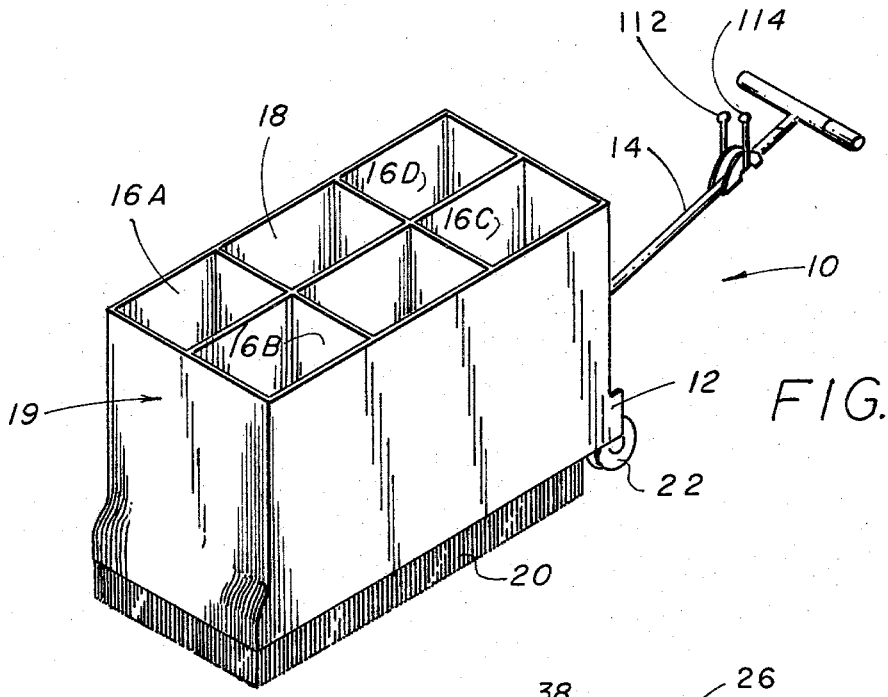
FIG. 1 is a perspective view of floor treating apparatus incorporating the features of this invention.

Referring now to the drawings, there is shown generally in FIG. 1 a perspective view of the present invention. As is shown, a carriage 12 has attached thereto a handle 14 for maneuvering and guiding the apparatus. Mounted to the top of carriage 12 is a plurality of dispensing chambers 16*a*, 16*b*, 16*c* and 16*d*. Also included is a receiving chamber 18. It will be apprecited that the dispensing chambers 16 and the receiving chamber 18 could be separate units or could be a molded single unit 19 having individual compartments as is shown. Scrubbing means 20 is reciprocally attached to carriage 12. As is shown in FIG. 1, scrubbing means 20 supports carriage 12 and the dispensing unit. To aid in controlling and manuevering the carriage unit 12, a pair of rollers 22 are also attached to carriage 12. It will be appreciated, that the scrubbing unit 20 may be selected to be any scrubbing means which would be most suitable for the cleaning or polishing job to be accomplished. For example, scrubber 20 could be brushes, steel wool pads or buffing pads for polish.

Figure 2:
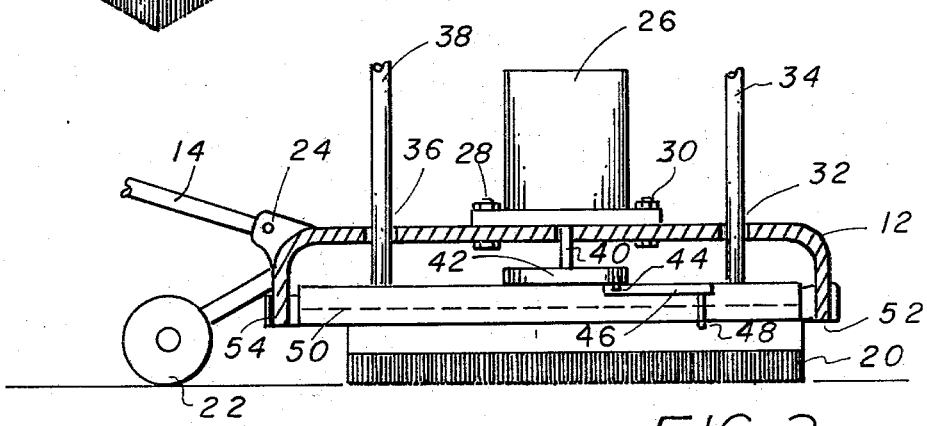
FIGS. 2 and 3 show two cross sectional views of the apparatus of FIG. 1 without the dispensing and receiving chambers, but showing the reciprocating action of the scrubber unit.
Figure 3:
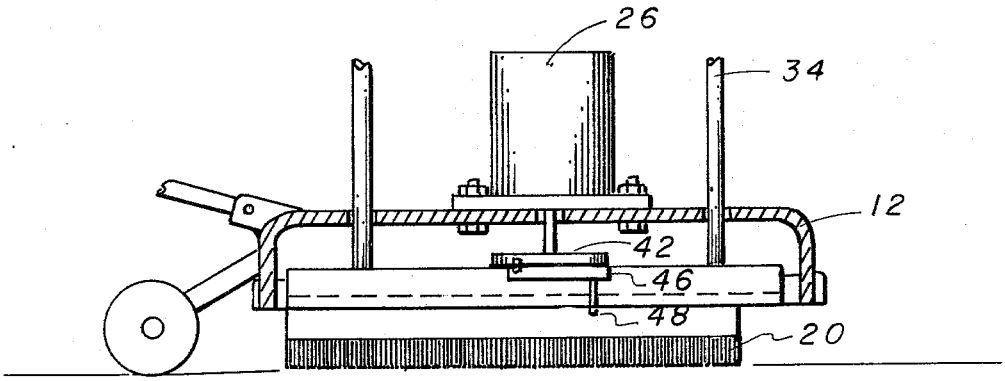

Referring now to FIGS. 2 and 3 the technique by which the reciprocating action of scrubbing unit 20 is accomplished will be explained. As is shown, FIGS. 2 and 3 show the apparatus of this invention without molded unit 19 so that other aspects of the invention can be seen. According to these Figures, it can be seen that handle 14 is pivotedly attached to carriage 12 at pivot point 24 and wheels 22 are also attached to carriage 12. Mounted at a central location on the top side of carriage 12 is a power drive means 26 such as an electrical motor. The housing for motor 26 could for example, be attached by bolts 28 and 30 as shown in the drawing, or could be a housing molded to and incorporated as a part of carriage 12. A first aperture 32 on the front of carriage 12 is suitable for allowing the passage of a transporting means such as a dispensing tube 34. In a similar manner, aperture 36 allows the passage of a second transporting means such as receiving or suction line 38. The purpose of, and the further details of dispensing line 34 and suction line 38 will be described in detail hereinafter. Motor 26 includes a drive shaft 40 to which is attached a fly wheel 42. Attached at the perimeter of fly wheel 42 is a pin 44. Pivotedly attached to pin 44 is a linkage 46, which itself has a further pin 48. In a manner to be described hereinafter, pin 48 imparts motion to scrubbing unit 20.

Figure 4:
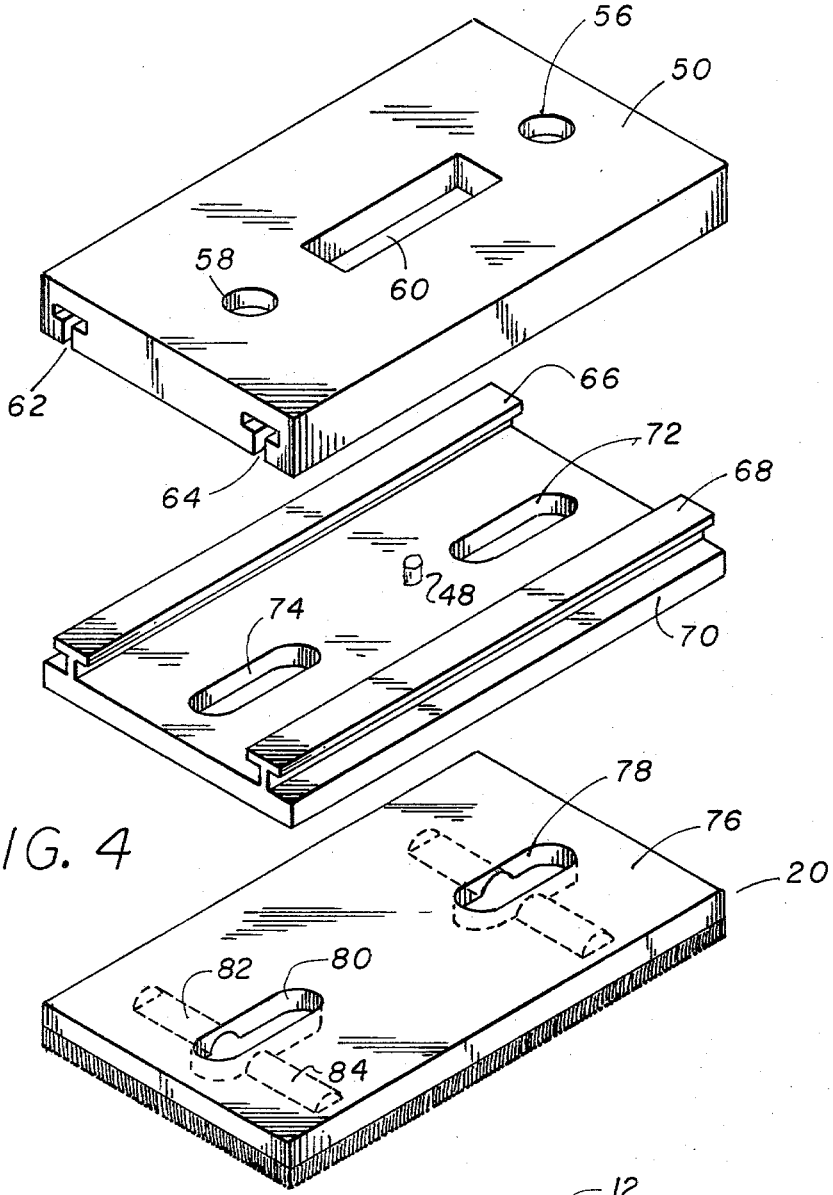
FIGS. 4 and 5 are exploded view showing how the reciprocating motion is achieved.
Figure 5:
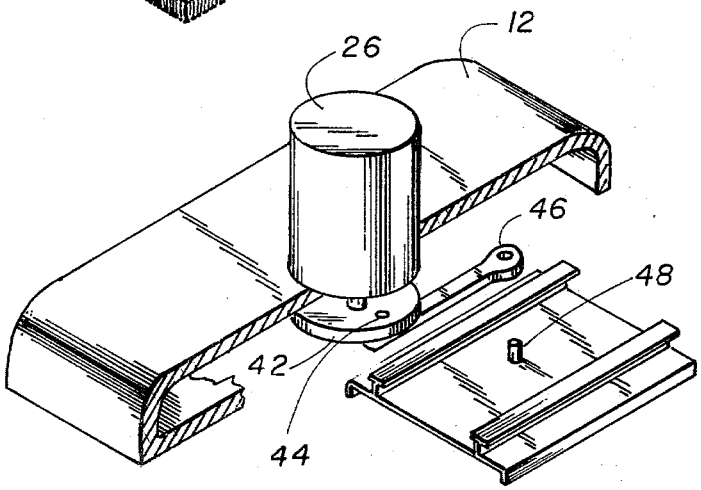

Referring now to FIG. 4, the technique of the reciprocating action of the apparatus of this invention will be discussed. Receiving guide plate 50 is mounted to carriage 12 by any suitable means such as by welding or bolts shown at 52 and 54 of FIGS. 2 and 3. Receiving guide plate 50 itself includes two apertures 56 and 58. These apertures match with apertures 32 and 36 respectively such that dispensing tube 34 and receiving tube or suction tube 32 may pass therethrough. Receiving guide plate 50 further includes a center slot 60 through which pin 48, which is attached to linkage 46, may be moved in a reciprocating manner. In the embodiment shown, receiving guide plate 50 also includes two receiving guide ways 62 and 64. In the illustrated embodiment, these guide ways are T shaped. However, it will be appreciated that dovetailed guide shaped guides or any suitable guide way could be used. Guide way 62 and 64 are suitable for receiving the T shaped guides 66 and 68 respectively. Thus, it can be seen that by inserting guides 66 and 68 in the receiving guide ways of guide plate 50, moving guide plate 70 is securely attached to receiving guide plate 50 but is free to move back and forth with reciprocating motion with respect to receiving guide plate 50. Moving guide plate 70 also includes apertures 72 and 74 respectively. These apertures are also aligned with the aperture 56 and 58 in receiving guide plate 50 such that the dispensing tube 34 and suction tube 38 may pass therethrough. It will be appreciated that these apertures are elongated so that moving guide plate 70 can moved with reciprocating motion. Scrubbing unit 20 is then releasably secured to moving guide plate 70. Any sort of quick release type attaching technique may be used to attach scrubbing unit guide plate 70. The quick release is desirable so that the scrubbing unit may be interchanged between a brush, steel wool or polishing type scrubbing unit. As is shown in FIG. 4, scrubbing unit 20 includes a backing plate 76 to which is attached the working part of the scrubbing unit such as a brush, steel wool pad or a polishing pad. Backing plate 76 also includes elongated apertures 78 and 80 for receiving the dispensing and suction tubes 34 and 38 respectively. In a preferred embodiment, backing plate 76 also includes auxilliary support rollers 82 and 84 to aid in maneuvering and guiding the apparatus of this invention. FIG. 5 is a perspective view of how the fly wheel 42 and the linkage 46 operates with respect to the moving guide plate 70. Thus, in operation it will be appreciated as the power drive means as motor 26 rotates, the fly wheel 42 will provide rotating motion to the off centered pin 44. Linkage arm 46 is attached between 44 on the fly wheel and center pin 48 on the moving guide plate. Thus, since moving guide plate 70 is restrained such that it can only experience reciprocating motion, it will be appreciated that as the fly wheel 42 rotates, such reciprocating motion will be imparted to moving guide plate 70. This reciprocating motion, is, of course, then in turn imparted to the scrubbing unit 20 which is secured thereto. Thus, to this point there has been described a scrubbing unit which does not use a rotating scrubbing action as was the case with the prior art scrubbing units, but uses a reciprocating scrubbing action which has unusual and unique benefits as will be described hereinafter.

Figure 6:
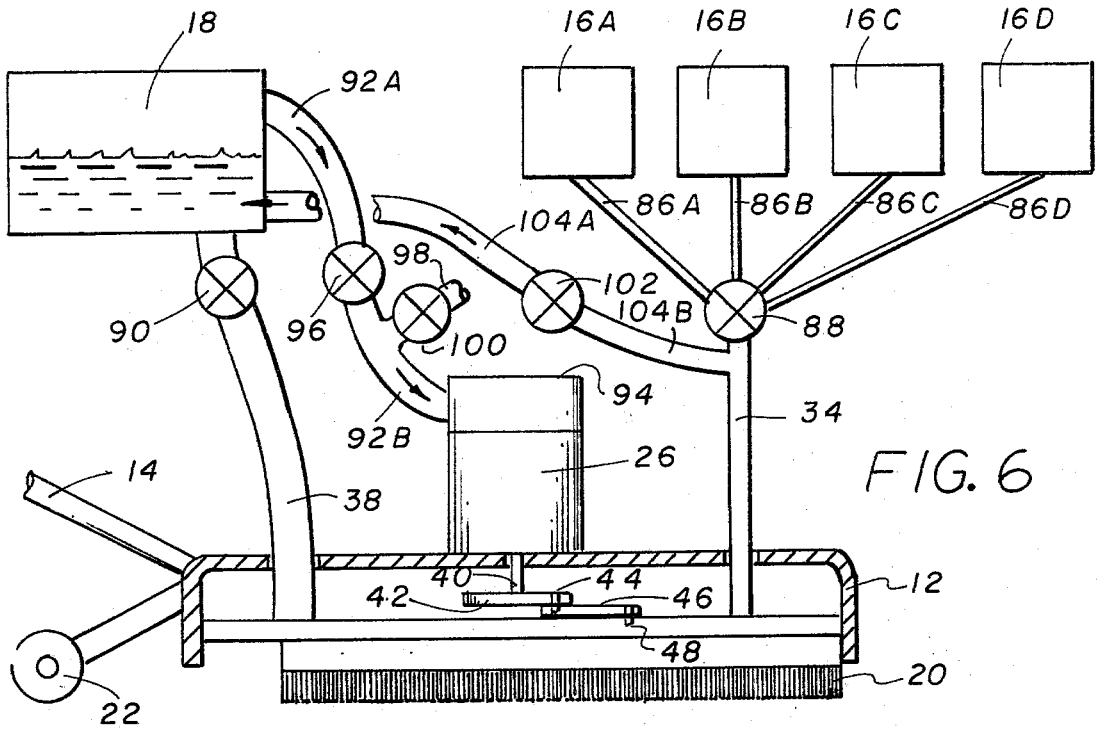
FIG. 6 is a part cross section and part block diagram show the dispensing and receiving chambers of the present invention.

Referring no to FIG. 6, there is a block diagram showing the fluid dispensing and fluid recovery aspects of the present invention. As shown, the individual dispensing chambers **16*a*, 16*b*, 16*c* and 16*d* are each individually connected by lines 86*a*, 86*b*, 86*c* and 86*d*. Each of these lines 86 then passes to a selection valve 88. The outlet of selection valve 88 is in turn connected to dispensing tube 34. Thus, it can be seen that by proper operation of selection valve 88, the liquid contained in one of the dispensing chambers 16*a* through 16*d* can be selected such that a fluid path exists between the selected chamber and dispensing tube 34. Consequently, the fluid contained in the selecting chamber will flow by gravity to its respective line, down through selection valve 88 through dispensing tube 34 and out of dispensing tube 34 at the front of the apparatus. Thus, the selected fluid will flow onto the floor being treated and will then in combination with the scrubbing unit 20 provide either cleaning, stripping or polishing action to the floor. As the device of this invention is maneuvered forward, the remaining liquid or surface liquid typically will pass below suction tube 38. Thus, any excess liquid remaining on the floor being treated after the scrubbing action, will be drawn up through suction tube 38, past valve 90 and into collecting or receiving resevoir 18. The suction found in tube 38 is imparted to the resevoir by means of a source tube 92*a* and 92*b* which is attached to a vacuum means 94 which in turn is driven by a power source 26. A cut off valve 96 is located between a portion 92*a* and portion 92*b* of source tube. In addition, an auxillary tube 98 is also attached to portion 92*b* of the source tube by means of cut off valve 100, which allows auxillary tube 98 to be connected to the vacuum source 94. Auxillary tube 98 may be used for any desirable auxillary attachments which may also require a suction or vacuum source. Thus, it can be seen that in a normal operation auxillary valve 100 will be closed, valve 96 will be open and valve 90 will be open such that the vacuum created by vacuum source 94 will be applied to suction tube 38 to draw the fluids into reservoir 18**.

It will be appreciated, however, that it would not be unusual for the apparatus of this invention to be pushed into a corner while cleaning the floor. In such an invention, the rear portion of the apparatus containing suction tube 38 cannot be maneuvered over the excess liquid on the floor. Thus, in such a situation it is difficult to draw up or vacuum away all such excess liquid. However, according to this invention, to solve this problem there is provided additional apparatus. Accordingly, in such an event, selection valve 88 is closed such that none of the fluids in the dispensing chamber can flow through dispensing tube 34 at the same time valve 90 is closed and valve 102 is open. Valve 102 is located between two portions 104*a* and 104*b* of a tube which is connected between dispensing tube 34 and receiving chamber 18. Thus, with valves 88 and 90 closed and valve 102 opened, it will be appreciated that a vacuum will now be applied to dispensing tube 34 such that any excess liquid left on the floor which cannot be removed by means of suction tube 38, can be removed through the dispensing tube 34 in a similar manner to that described with respect to suction tube 38. Therefore, it will be seen that the present invention provides the unique characteristic of being particularly applicable for removing excess liquid from floors being treated even when such excess liquid is located in the corner of a floor.

Figure 7:
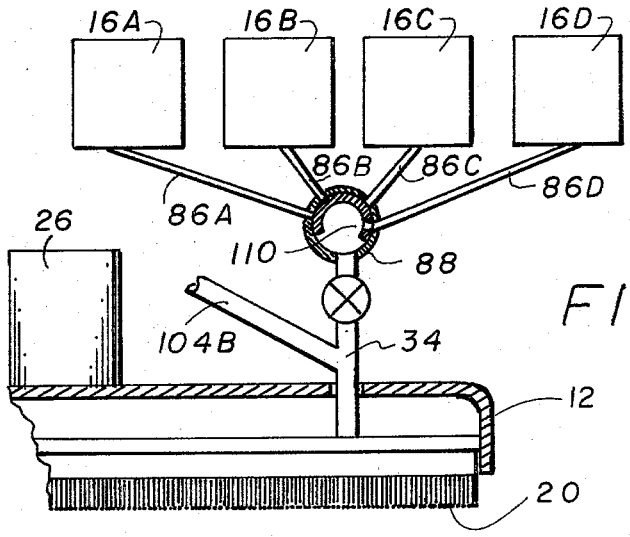
FIG. 7 shows a selection valve and how it operates with respect to the dispensing chamber.
Figure 8:
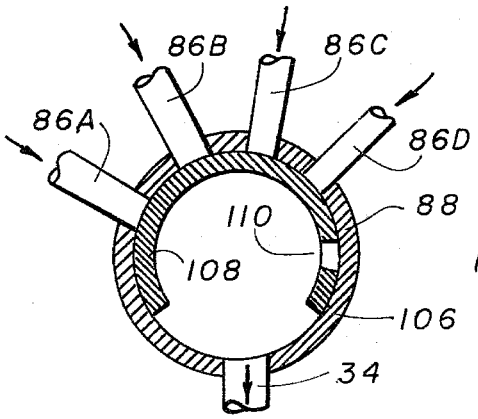
FIG. 8 is an enlarged view of the selection valve of FIG. 7 showing the valve in a closed position so that no fluids are dispensed.

Referring now to FIGS. 7 and 8, there is shown a more detailed view of the dispensing selection process of the apparatus of this invention. Accordingly, it can be seen that selection valve 88 can be selected to have a substantially cylindrical shape. Inside cylindrical cylinder 106 of selection valve 88 is a partially cylindrical shaped rotating unit 108 having a first aperture 110 which can be selectively positioned to match with the location of input tubes 88, 86*b*, 86*c* and 86*d* as desired. For example, as is shown in FIG. 7 slot 110 is selected to match up with dispensing tube 86*d* such that a continuous liquid communication path is achieved from dispensing chamber 16*d* through dispensing tube 86*d*, through aperture 110 and into dispensing tube 34. It will be appreciated that the internal cylindrical unit 108 could be rotated to similarly match up with any of the other dispensing tubes such as 86*a* and 86*c*. Thus, it will be appreciated that any of the fluids contained in the dispensing chambers may be selected. However, it is often the case, that no fluid is desired or in the event it is desirable to use dispensing tube 34 as a suction tube 34, the internal cylindrical unit 108 may be rotated to a position such as is shown in FIG. 8 so that all of the dispensing chambers are cut off from dispensing tube 34.

Thus, it will be appreciated that in operation of the present apparatus, the machine operator may select (by selection levers 112 and 114 shown in FIG. 1) any one of the dispensing chambers 16*a* through 16*d*. At the same time, valve 90 will be open, so that as power source 26 operates, reciprocating action will be applied to brushes 20 and a vacuum will be applied to suction tube 38. Thus, it will be appreciated that the selected fluid, such as for example, a cleansing or stripping fluid will flow down through the dispensing tube 34 onto the floor being treated so that as the floor is scrubbed with scrub brush 20, the floor will be cleaned. As the unit is moved forward, the excess liquid will be drawn off and up through suction tube 38 and into receiving chamber 18. It will then be possible to select a second chamber which may, for example, contain nothing more than rinse water. The machine is again moved over the floor thereby rinsing the floor of the cleaning fluid and sucking the excess rinse water up through suction tube 38 into reservoir 18. Once rinsed, the floor could either be treated with a further cleaning solution or could be treated with a liquid wax contained in one of the other dispensing chambers. Liquid wax would also be applied to the floor in a manner somewhat similar to that of the cleaning fluid, wherein the excess wax would be drawn up into receiving chamber 13. It will be appreciated that the cleaning and floor treating apparatus of this invention provides unique capabilities of treating floors made of almost any material. The floors are scrubbed or polished by a reciprocating action which does not leave swirl marks as is the case with the rotating scrubbing action of prior devices.

Thus, although the present invention has been described with respect to specific apparatus providing reciprocating action to a scrubbing unit and to specific apparatus for dispensing and removing excess liquids, it is not intended that such specific references be considered limitations upon the scope of this invention except in so far as set forth in the following claims.

I claim:

1. Apparatus for cleaning and treating the surface of a floor comprising:

a carriage means having a handle for guiding and maneuvering said apparatus;

a plurality of dispensing chambers attached to said carriage means for holding a selection of floor cleaning and treating fluids;

reciprocating scrubbing means moveably attached to said carriage means and suitable for use with said selection of fluids for cleaning and treating said floor surfaces;

first transporting means connected to said dispensing chambers and a front portion of said scrubbing means for transporting a selected fluid from said dispensing chambers to said scrubbing means, said first transporting means including a first cut off valve cooperating with said transporting means for selectively interrupting the flow of said selected fluid to said scrubbing means;

a receiving chamber attached to said carriage means suitable for receiving any excess of said selected fluids used for treating said floor surfaces;

vacuum means for creating a vacuum at said receiving chamber;

second transporting means connected between a rear portion of said scrubbing means and said receiving chamber such that said vacuum at said receiving chamber is applied to said second transporting means for transporting excess cleaning or treating fluid from said rear portion of said scrubbing means to said receiving chamber;

a third transporting means having a first end and a further end and a second cut off valve between said first end and said further end, said third transporting means connected to said receiving chamber at said first end and to said first transporting means at said further end such that said first cut off valve may be closed to interrupt the flow of a selected fluid from said dispensing chambers and said second cut off valve opened to create a vacuum at said first transporting means such that excess cleaning or treating fluid may be transported from said front part of said scrubbing means to said receiving chamber; and power means for driving said vacuum means and for imparting said reciprocating motion to said scrubbing means.

2. The apparatus of claim 1 further comprising a selection valve connected to said plurality of dispensing chambers and said first transporting means, such that the fluid in only one of said plurality of dispensing chambers at a time can be selected to be transported to said scrubbing means.

3. The apparatus of claim 1 or 2 wherein said carriage means comprises a frame to which said handle is rotatably attached; and a receiving guide plate securely mounted to said frame, said receiving guide plate including a receiving guide or way on one surface of said receiving guide plate; a moving guide plate having a guide or way protruding on one surface of said moving guide plate for cooperating with said receiving guide or way such that said moving guide plate may move in a reciprocating motion with respect to said receiving guide plate as determined by said guide or ways; and wherein said scrubbing means is selectively attached to said moving guide plate.

4. The apparatus of claim 1 wherein said scrubbing means further includes support rollers.

5. The apparatus of claim 1 wherein said carriage means includes a support roller.

6. The apparatus of claims 1 or 2 wherein said scrubbing unit is suitable for stripping, cleaning and polishing.

* * * * *